US005953765A

United States Patent [19]

Hayashi et al.

[11] Patent Number: 5,953,765

[45] Date of Patent: Sep. 21, 1999

[54] SANITARY DEVICE HAVING COMMONLY DRIVEN WASHING AND DRYING DEVICES

[75] Inventors: Kouichi Hayashi, Nishikomo-gun; Yuji Yamaguchi, Anjo, both of Japan

[73] Assignee: Aisin Seiki Kabushiki Kaisha, Kariya, Japan

[21] Appl. No.: 08/804,256

[22] Filed: Feb. 21, 1997

[51] Int. Cl.[6] ..... A47K 3/20

[52] U.S. Cl. ..... 4/420.4

[58] Field of Search ..... 4/420.1–420.5, 4/443–448

[56] References Cited

U.S. PATENT DOCUMENTS

| | | | |
|---|---|---|---|
| 5,706,525 | 1/1998 | Olivier | 4/420.4 |
| 5,765,238 | 6/1998 | Furykawa et al. | 4/420.4 |

FOREIGN PATENT DOCUMENTS

| | | | |
|---|---|---|---|
| 59-192970 | 12/1984 | Japan . | |
| 6-193115 | 7/1994 | Japan | 4/448 |
| 6-193118 | 7/1994 | Japan | 4/448 |

*Primary Examiner*—Charles R. Eloshway

*Attorney, Agent, or Firm*—Oblon, Spivak, McClelland, Maier & Neustadt, P.C.

[57] ABSTRACT

A sanitary device includes a washing device for washing a human anus portion by ejecting water under pressure therefrom when the washing device is transferred from its rest position to an operating position, a driving device for moving the washing device between the rest and operating positions, a drying device for drying the washed human anus portion by blowing thereon hot air from an opening of a distal end of a duct and an air deflector provided rotatably to the duct and located near the opening. The motor which drives the driving device also rotates the air deflector.

12 Claims, 5 Drawing Sheets

SANITARY DEVICE HAVING COMMONLY DRIVEN WASHING AND DRYING DEVICES

BACKGROUND OF THE INVENTION

1. Field of the Invention

The present invention relates to a sanitary device and in particular to an improvement of a drying means of a sanitary device.

2. Description of the Related Art

In a conventional sanitary device disclosed, for example in Japanese unexamined Utility Model application No. 192970-1984, there is provided an air deflector having a plurality of equally spaced swing plates which may be swung concurrently in front of an opening of a duct. By driving such plates periodically or reciprocally, hot air blown from the opening toward a human anus portion can reach the entire anus portion. As a means for driving such a air deflector, a motor is used which is located at a side of the opening of the duct.

However, in the conventional device mentioned above, since the opening of the duct is within a toilet bowl, the motor located at such a position has to be waterproof, and so the portion for accommodating the motor has to be formed integrally with the duct. Thus, the structure in the vicinity of the duct is complex.

SUMMARY OF THE INVENTION

It is therefore an object of the present invention to provide a sanitary device without the aforementioned drawback.

In order to eliminate the above and other drawbacks, the present invention provides a sanitary device comprising washing means movable between a rest position and an operating position for washing a human anus portion by ejecting an amount of water under pressure thereto when the washing means is positioned at the operating position; drying means having a duct for drying the washed human anus portion by blowing hot air thereon from an opening at a distal end of said duct; an air deflector rotatably mounted to said duct near the opening of said duct; driving means for moving the washing means between the rest position and the operating position and for reciprocally rotating the air deflector; and control means operatively connected to said driving means for causing the driving means to reciprocally rotate the air deflector.

In accordance with the present invention, since the air deflector is rotated reciprocally by the driving means which also drives the washing means, no additional means for driving only the air deflector is required, with the result that the conventional drawback is eliminated.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
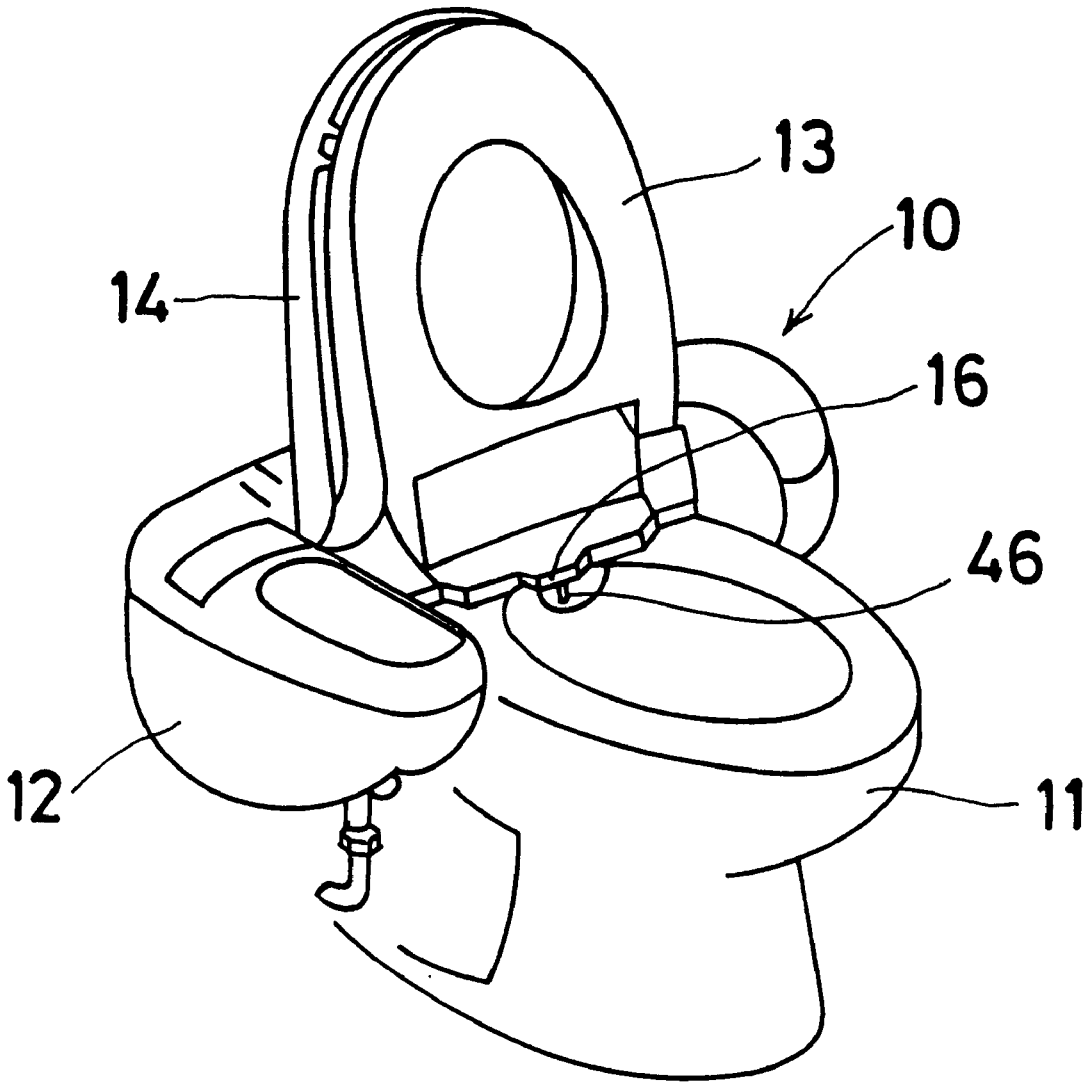
FIG. 1 is a perspective view of a toilet device to which is applied an embodiment of a sanitary device according to the present invention.

Referring to FIGS. 1 through 6, there is illustrated a sanitary device 10 to which the present invention is applied. It includes a casing 12 which is mounted on a rear end portion of a toilet bowl 11 having a seat 13 and a lid hingedly connected to the casing 12 by a pair of common axis pins (not shown), as is well known.

Within the casing 12, there is disposed a washing device 20 which includes a bracket 21 secured to the casing 12 and a cylinder assembly 22 mounted slidably on the bracket 21. The cylinder assembly 22 has a first cylinder portion 23 and a second cylinder portion 24 both of which are connected mutually for unitary movement. The first cylinder portion 23 and the second cylinder portion 24 are respectively provided with extendible nozzles 25 and 26. Both nozzles 25 and 26 are oriented toward an interior of a toilet bowl 11 through an opening 16 of the casing 12.

Figure 2:
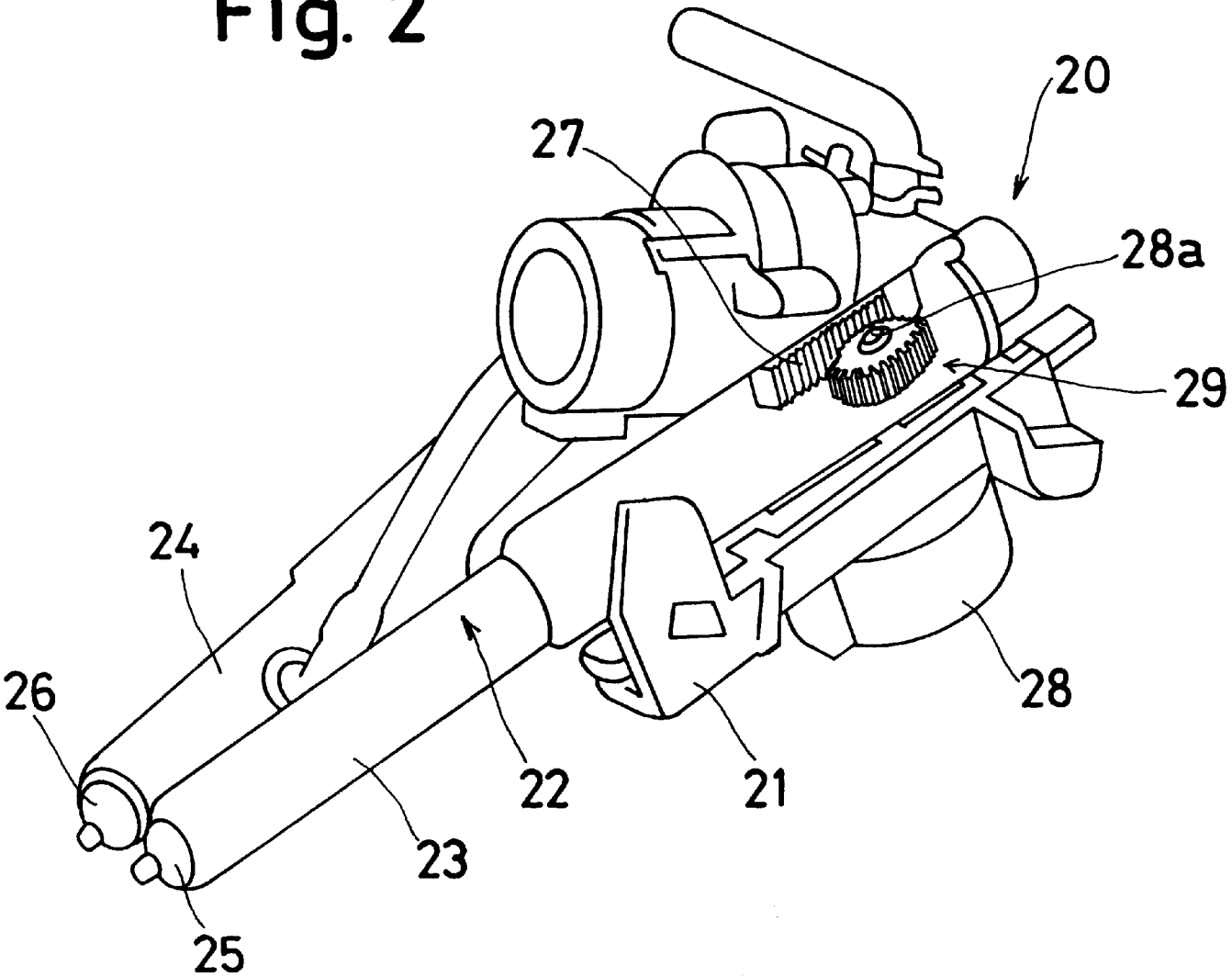
FIG. 2 is a perspective view of a washing device of a sanitary device according to the present invention.

The cylinder assembly 22, as best shown in FIG. 2, is provided with moving means in the form of a rack 27 which is in meshing engagement with a pinion 29 secured to a shaft 28*a* of a motor 28. The motor 28 is turned on by a signal of a controller or CPU 33 of a control device 30 when an anus washing switch 31 or a crotch washing switch 32 of the control device 30 is closed, as a result of which the cylinder assembly 22 is moved or extended from its rest position to its operating position. As soon as the cylinder assembly 22 reaches the operating position, the nozzles 25 and 26 extend to a washing position due to water pressure, and the (normally warmed) washing water is ejected from distal end portions of the nozzles 25 and 26 toward an anus portion (crotch portion) of a user on the seat 13 for the washing thereof, as is well known. Upon closure of a stop switch 35 during such washing, the ejection of the water is terminated and the controller 33 causes the motor 28 to return the cylinder assembly 22 to the rest position. If a dry operation switch 34 is closed during anus portion washing, washing is terminated and the anus portion is subsequently dried by hot air generated by a drying device 40 as will be described later.

Figure 3:
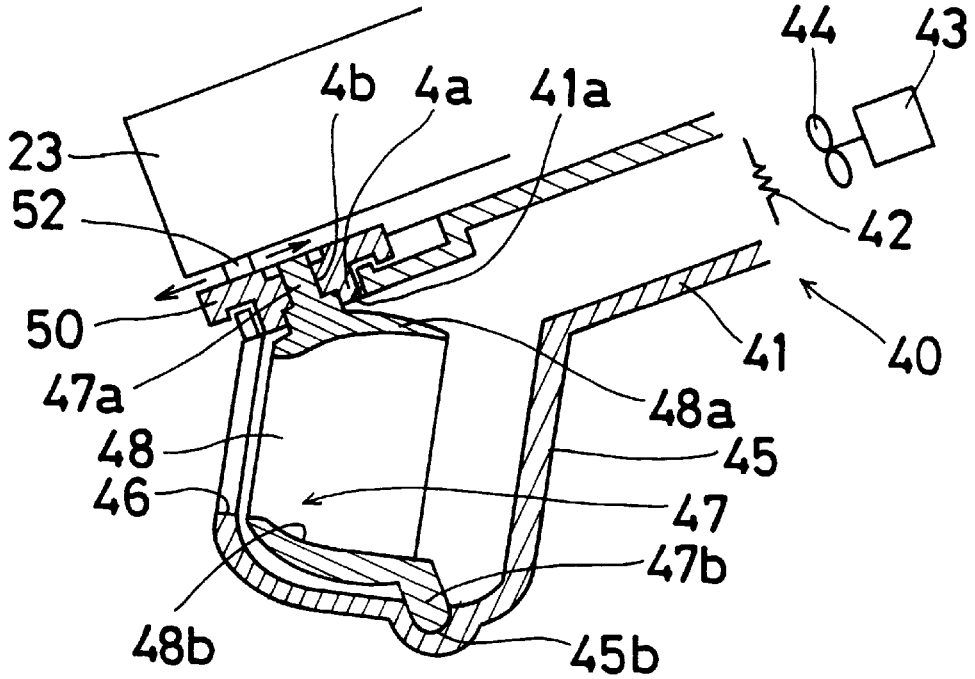
FIG. 3 is a cross-sectional view of a principal portion of a sanitary device according to the present invention.

The drying device 40, as best shown FIG. 3, includes a duct 41 formed integrally with the casing 12 and extended toward the interior of the toilet bowl 11 so as to be positioned beneath the cylinder assembly 23. At an innermost portion of the duct 41, there are installed a heater 42 and a fan 44 driven by a motor 43, thereby forming a warm air blower. A distal end portion 45 of the duct having a blowing opening 46 is formed with a downwardly enlarged configuration.

An air deflector 47 having a passage 48 is provided within the distal end portion 45. The passage 48 of the air deflector 47 has an upper wall 48*a*, a lower wall 48*b*, and a pair of side walls 48*c* and 48*d* connecting respectively both the upper and lower walls 48*a* and 48*b*. Upon closure of the drying switch 34, the drying device 40 is brought into operation, the heater 42 is energized and ambient air is warmed to a desired temperature. The resulting warmed air is blown through the duct 41, the air deflector 47 and the opening 48, and toward the wet, washed anus portion.

A projection 47*a* is formed at an upper portion of the air deflector 47 and is fixed in a central portion of a link plate

50 which is rotatably fitted in an opening 41*a* of the duct 41. A projection 47*b* is formed at a lower portion of the air deflector 47 and is rotatably fitted in a hole 45*b* formed in a lower portion of the distal end portion 45. Thus, when the link plate 50 is rotated within the hole 41*a*, the air deflector 47 is rotated together with the link plate 50 and the flow direction of the hot air blown from the blowing opening 46 is varied.

Figure 4:
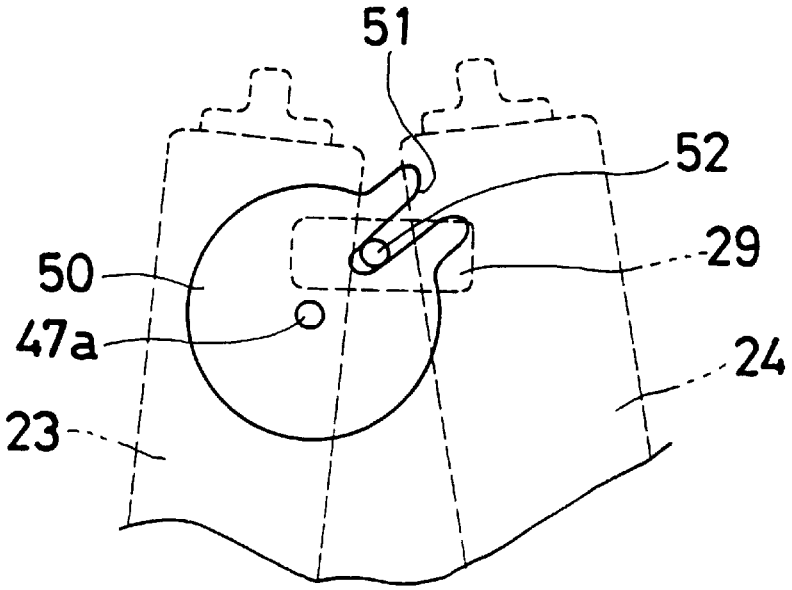
FIG. 4 is a plan view of a link mechanism.
Figure 5:
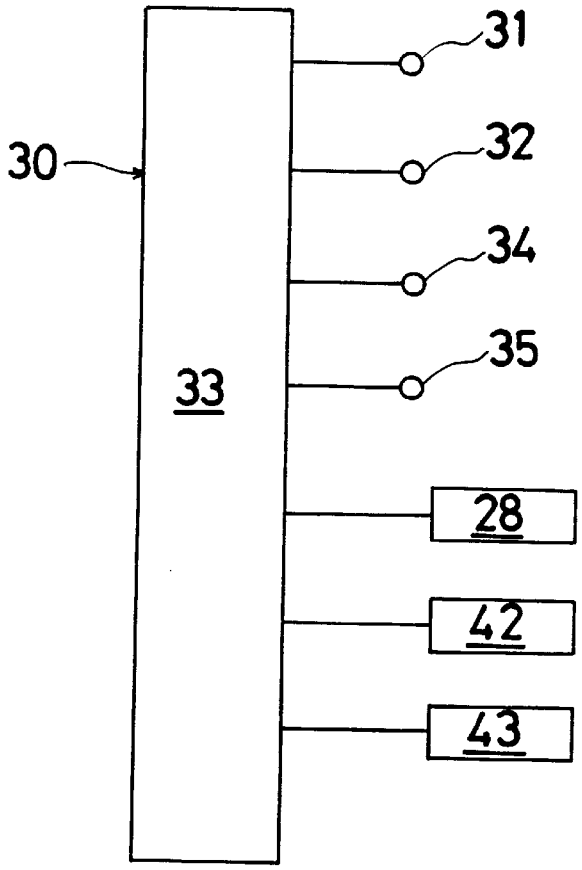
FIG. 5 is a block-diagram of a control device of a sanitary device according to the present invention.
Figure 6:
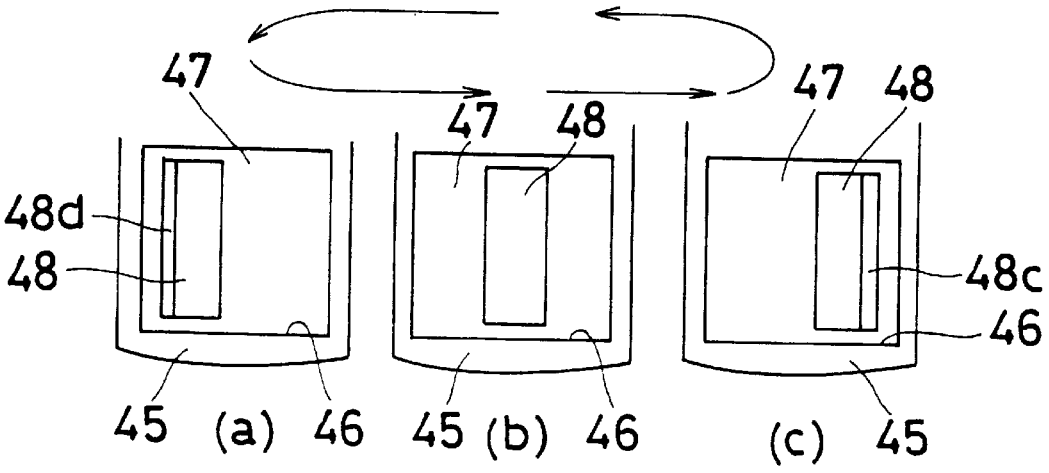
FIGS. 6(*a*)–6(*c*) show three positions of an air deflector during its reciprocation.

As can be seen from FIG. 4, the link plate 50 has a radial slit or cutout 51 into which a pin 52 extends downwardly from a plate 29*a* bridging or connecting both cylinder portions 23 and 24. Thus, movement of the cylinder assembly 22 causes rotation of the link plate 50. When the drying device 40 operates after anus portion washing, the controller 33 causes the cylinder assembly 22 to reciprocate forward and backward between two positions. Due to this reciprocal movement of the cylinder assembly 22, the link plate 50 is rotated by the pin 52 and the relative position of the air deflector 47 to the blowing opening 46 changes periodically or reciprocally in the sequence of (a), (b), (c), (b), (a), etc. in FIG. 6.

Figure 7:
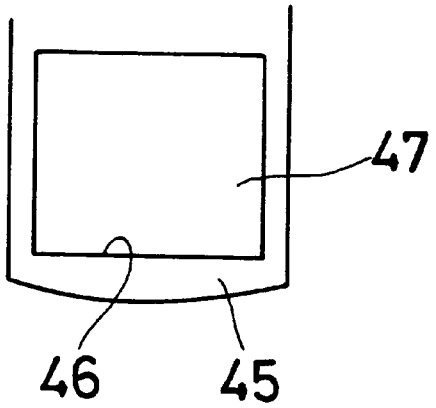
FIG. 7 shows the state of an air deflector when the washing device is at its rest position.

It is to be noted that one position of the reciprocal movement of the air deflector 47 is coincident with the operating position of the cylinder assembly 22 and the other positions are between the rest and the operating positions. In addition, the link plate can be rotated so as to close the blowing opening by the air deflector 47, as shown in FIG. 7, when the cylinder assembly 22 is at its rest position. The air deflector 47 can therefore be used as a shutter for the duct 41. Furthermore, since the force for rotating the air deflector 47 is derived from the motor 28, no separate motor is required for rotating the air deflector 47.

Figure 8:
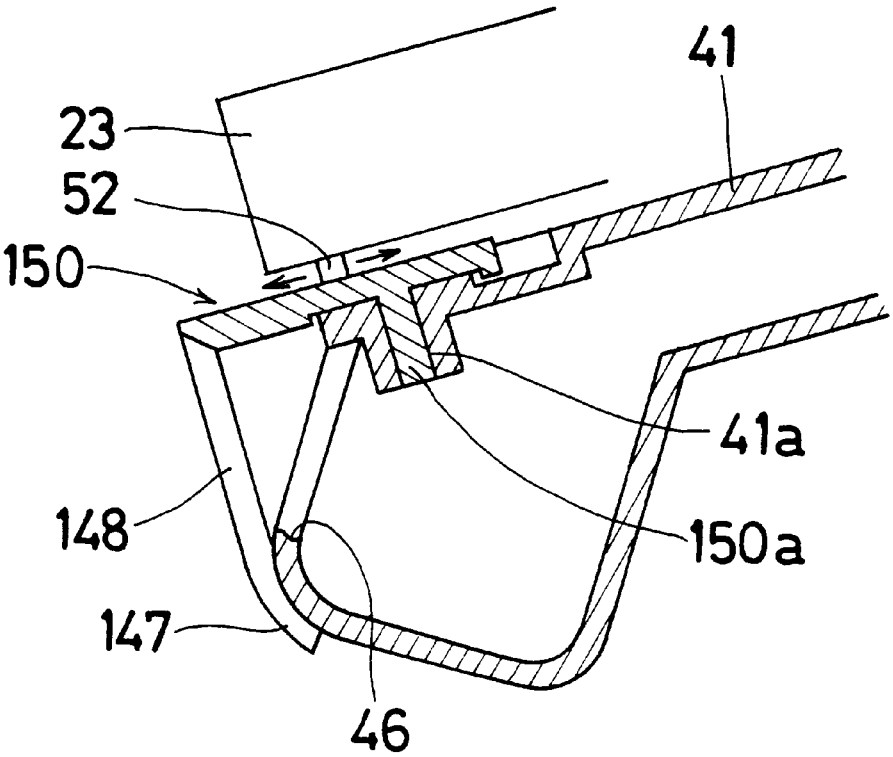
FIG. 8 shows a modification of the air deflector of FIG. 3.

As shown in FIG. 8, a modified link plate 150 has a portion extending beyond the distal end portion of the duct 41. The link plate 150 has a shaft 150*a* which is rotatably fitted in the hole 41*a* of the duct 41 above the distal end thereof. An air deflector 147 having an passage 148 is formed integrally with a front end portion of the link plate 150 so as to be brought into opposition to the blowing opening 46.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A sanitary device comprising:

washing means movable between a rest position and an operating position for washing a human anus portion by ejecting an amount of water under pressure therefrom when the washing means is positioned at the operating position;

drying means having a duct for drying the washed human anus portion by blowing warm air thereon from an opening at an end of said duct;

an air deflector rotatably mounted to said duct near the opening of said duct;

driving means for moving the washing means between the rest position and the operating position and for reciprocating the air deflector; and control means operatively connected to said driving means for causing the driving means to reciprocate the air deflector constantly during a drying operation.

2. A sanitary device in accordance with claim 1, wherein said driving means includes moving means for moving said washing means and a link mechanism connecting the washing means and the air deflector such that the movement of said washing means rotates said air deflector.

3. A sanitary device in accordance with claim 2 wherein said moving means comprises a motor controlled by said control means and operatively connected to said washing means so as to move said washing means to any position between and including said rest and operating positions.

4. A sanitary device in accordance with claim 1, wherein said air deflector is positioned within the distal end of the duct.

5. A sanitary device in accordance with claim 1, wherein said air deflector is positioned outside the opening of the duct.

6. A sanitary device in accordance with claim 1, wherein said air deflector comprises means for closing the opening of the duct when the washing means is at the rest position.

7. A sanitary device in accordance with claim 1, wherein said air deflector is configured to reciprocate laterally with respect to a user's buttocks when the user is sitting on a toilet including said sanitary device.

8. A sanitary device in accordance with claim 1, wherein said air deflector is configured to reciprocate in a substantially horizontal plane.

9. A sanitary device for washing and drying a human anus portion, comprising:

a washing device having at least a portion which is mounted so as to reciprocate between a rest position and an operating position in which the washing device can eject water to wash a human anus portion;

a motor operatively connected to said washing device for moving said portion of said washing device between the rest position and the operating position;

a blower positioned for blowing drying air toward a human anus portion washed by said washing device;

an air deflector positioned to deflect the air blown by said blower; and means connected to said motor for causing the motor to reciprocate said air deflector constantly during a drying operation.

10. A sanitary device in accordance with claim 9, further including a controller for controlling said motor to reciprocate said portion of said washing device, thereby reciprocating said air deflector, during operation of said blower, whereby a human anus portion washed by said washing device may be dried.

11. A sanitary device in accordance with claim 9, wherein said means for causing the motor to reciprocate said air deflector is configured to reciprocate the direction drying air laterally with respect to a user's buttocks when the user is sitting on a toilet using said sanitary device.

12. A sanitary device in accordance with claim 9, wherein said means for causing the motor to reciprocate said air deflector is configured to reciprocate the direction of driving air in a substantially horizontal plane.

* * * * *

UNITED STATES PATENT AND TRADEMARK OFFICE

CERTIFICATE OF CORRECTION

PATENT NO. : 5,953,765

DATED : September 21, 1999

INVENTOR(S) : Kouichi HAYASHI, et al.

It is certified that error appears in the above-identified patent and that said Letters Patent is hereby corrected as shown below:

On the title page, item [30] has been omitted. It should be:

--[30] Foreign Application Priority Data
Feb. 21, 1996 [JP] Japan ..... 8-34055
Feb. 13, 1997 [JP] Japan ..... 9-29241--

Signed and Sealed this

First Day of August, 2000

*Attest:*

Q. TODD DICKINSON

*Attesting Officer*

*Director of Patents and Trademarks*